United States Patent [19]

Heiss et al.

[11] Patent Number: 4,992,914

[45] Date of Patent: Feb. 12, 1991

[54] ILLUMINATED STEPPING STONES

[76] Inventors: Charles E. Heiss, 4798 Coyote Well Cir., Westlake Village; Lawrence S. Gluck, 2252 Hollowpark Ct., Thousand Oaks, both of Calif. 91362

[21] Appl. No.: 415,861

[22] Filed: Oct. 2, 1989

[51] Int. Cl.[5] ..... F21S 1/02

[52] U.S. Cl. ..... 362/153.1; 362/364; 362/806

[58] Field of Search ..... 362/153, 153.1, 364, 362/806; 404/9, 11, 12, 23

[56] References Cited

U.S. PATENT DOCUMENTS

| | | | |
|---|---|---|---|
| 640,140 | 12/1899 | Lloyd | 362/310 |
| 1,686,363 | 10/1928 | Baldwin | 362/153 |
| 2,180,105 | 11/1939 | Farrell | 404/9 |
| 2,303,462 | 12/1942 | Horne | 404/9 |
| 4,697,950 | 10/1987 | Copeland | 362/153.1 |
| 4,744,014 | 5/1988 | Harris | 362/153 |

FOREIGN PATENT DOCUMENTS

| | | | |
|---|---|---|---|
| 2527754 | 1/1977 | Fed. Rep. of Germany | 362/153.1 |
| 396461 | 8/1933 | United Kingdom | 404/11 |

*Primary Examiner*—Ira S. Lazarus
*Assistant Examiner*—Richard R. Cole
*Attorney, Agent, or Firm*—Jack C. Munro

[57] ABSTRACT

An illuminated stepping stone which is light in weight, of sufficient strength to support a human being of extremely heavy weight, is attractive in appearance and can be manufactured inexpensively. Illumination of the stepping stone is by means of a low voltage source of electricity. Multiple stepping stones are to be connected together and illuminated from a source of electricity.

15 Claims, 1 Drawing Sheet

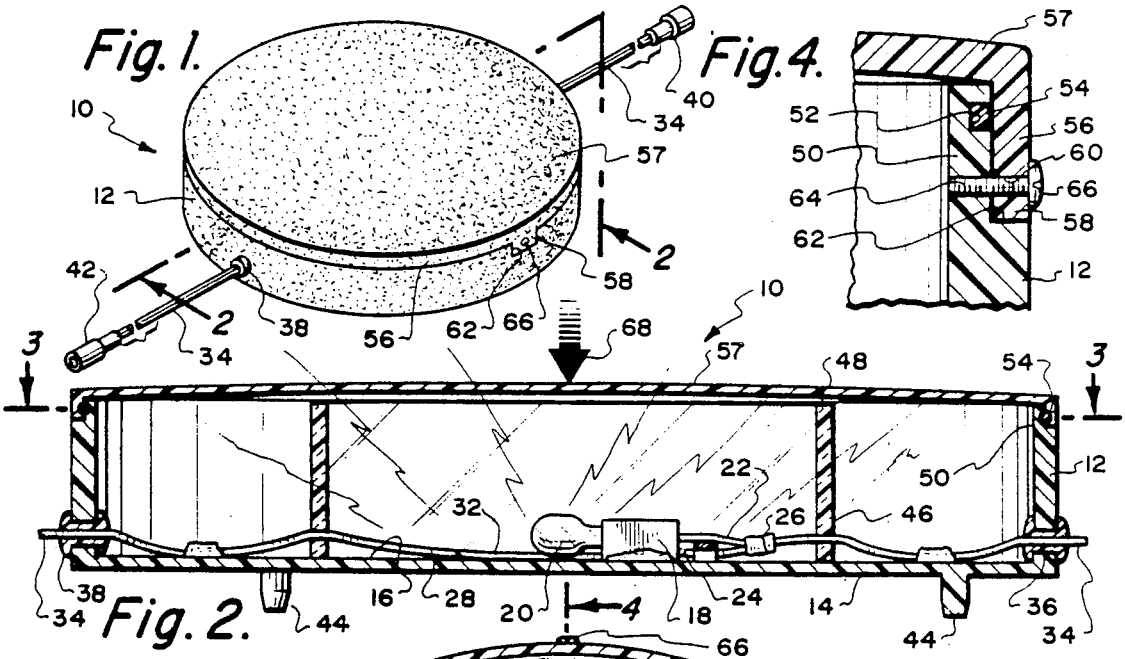
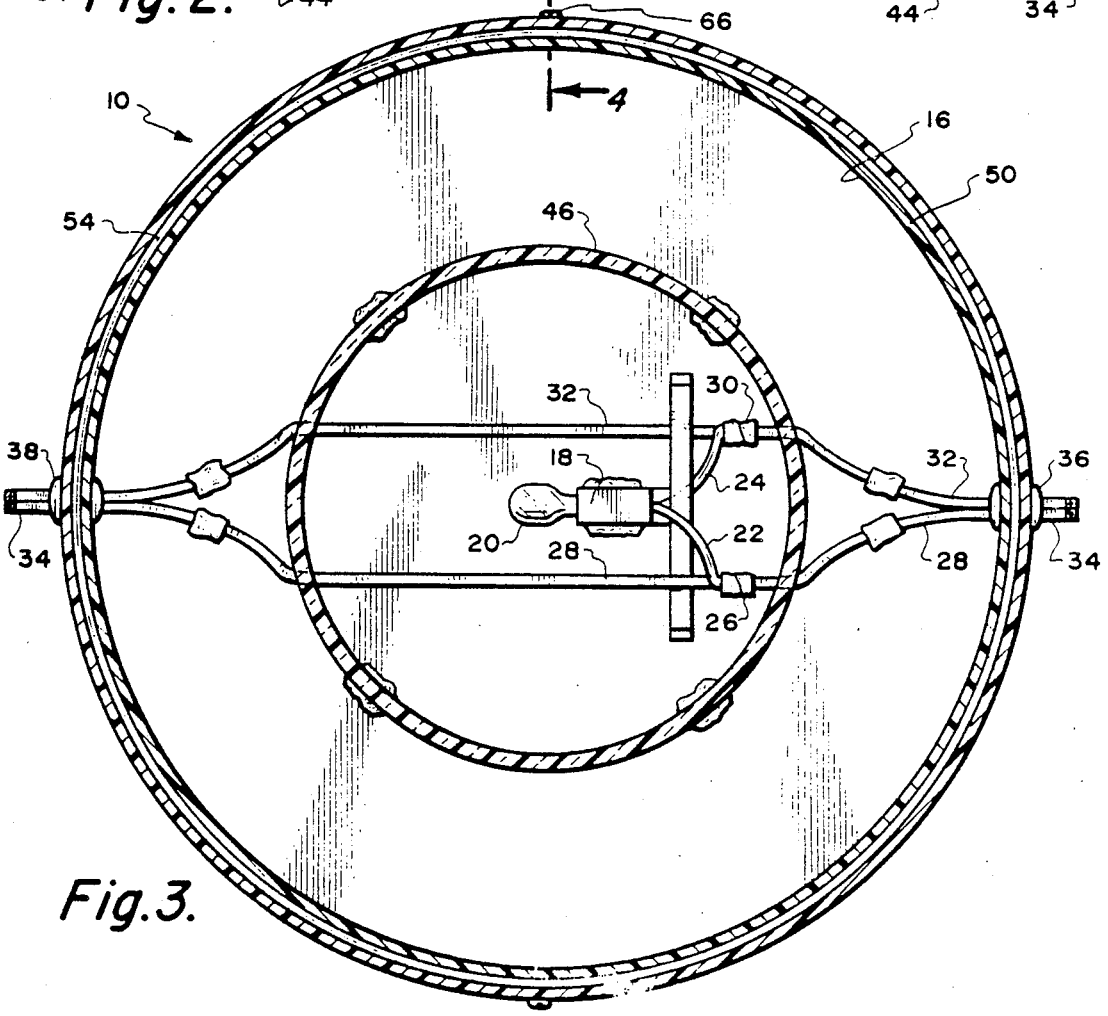
Fig. 3.

ILLUMINATED STEPPING STONES

BACKGROUND OF THE INVENTION

The field of this invention relates to construction materials and more particularly to a stepping stone which is designed to be used in gardens, lawns or other landscaped terrain to provide a designated path area.

Stepping stones within path areas of a landscaped environment has long been known. The most common form of stepping stone is constructed either of rock or cement. Generally, a stepping stone is designed to be attractive in appearance. The stepping stone is also designed to be of heavy weight so as to be able to adequately support the localized weight of a human being as a human being walks from one stepping stone to another.

In the past, there have been attempts to illuminate different devices associated with landscaping terrain. Planters have been known to be illuminated, curbing has been known to be illuminated, steps have been known to be illuminated, bricks and blocks have been known to be illuminated and even stepping stones have been known to be illuminated by embedding a plurality of small light bulbs with the top surface of a stepping stone. This type of illuminated stepping stone is still constructed of a rock or cement material with the top surface of the stepping stone being cut to form chambers within which are mounted the separate light bulbs. However, this type of illumination of a stepping stone is only partial. The top surface of the stepping stone is not totally illuminated. Also, because of the labor required in the constructing of such stepping stones, such stepping stones are known to be expensive.

SUMMARY OF THE INVENTION

A stepping stone constructed of a translucent plastic within which is mounted a light source. Activation of the light source causes a glowing illumination of the top surface of the stepping stone. The light source is mounted within an internal chamber of the stepping stone. The internal chamber includes a ring-shaped support which is slightly spaced from the top surface of the stepping stone when such is in its normal at rest position. Upon the stepping stone encountering a pressing force of sufficient magnitude, such as when a human being steps on the stone, the top surface will deflect and be supported by the support ring to prevent collapsing of the stepping stone.

One of the primary objectives of the present invention is to construct a stepping stone which can be illuminated so as to "glow in the dark" to indicate to a human being the location of the stepping stone when it is dark so that the individual will know where to step when traversing a certain landscaped area within a yard or other similar type of location.

Another objective of the present invention is to construct a stepping stone which is light in weight but yet strong enough to support heavy human beings.

Another objective of the present invention is to construct a stepping stone which can be illuminated with a very small amount of electricity thereby minimizing the use of electricity and hence its expense.

Another objective of the present invention is to construct a stepping stone which is substantially unaffected by natural conditions such as snow, rain, cold and heat.

Another objective of the present invention is to construct a stepping stone wherein the outer surface of the top of the stepping stone is textured to provide a substantially non-slip surface even when water is caused to come into contact with the stepping stone.

BRIEF DESCRIPTION OF THE DRAWING

FIG. 1 is an isometric view of the stepping stone of the present invention taken in a direction in order to observe the top of the stepping stone;

FIG. 2 is a cross-sectional view through the stepping stone taken along line 2—2 of FIG. 1 showing clearly the illuminating means mounted in conjunction with the stepping stone;

FIG. 3 is a cross-sectional view taken in a direction from the top of the stepping stone taken along line 3—3 of FIG. 2; and FIG. 4 is a cross-sectional view through a portion of the side wall of the stepping stone of the present invention taken along line 4—4 of FIG. 3.

DETAILED DESCRIPTION OF THE SHOWN EMBODIMENT

Referring particularly to the drawing, there is shown the stepping stone 10 of this invention. The stepping stone 10 is formed of a base defined by an annular side wall 12 and a bottom surface 14. The upper surface of the bottom 14 and the inner wall surface of the side wall 12 cooperate together to enclose an internal compartment 16. Substantially centrally disposed within this internal compartment 16 and fixedly mounted against the bottom 14 is a light socket 18. Mounted within the socket 18 is a conventional light bulb 20. From the socket 18, extends a pair of electrical wires 22 and 24. Wire 22 is electrically connected at junction 26 with electrical conductor 28. In a similar manner, the wire 24 is electrically connected at junction 30 to electrical conductor 32. Wires 28 and 30 are joined together forming a wire 34. Wire 34 is conducted through a moisture seal grommet 36 which is mounted within side wall 12 with another portion of the wire 34 being mounted within a similar moisture seal grommet 38 again mounted within the side wall 12. Grommets 36 and 38 are identical. The grommets 36 and 38 are located diametrically opposite each other relative to the side wall 12.

A portion of the wire 34 that extends from the grommet 36 is connected to a female electrical connector 40. A portion of the wire 34 that extends from the grommet 38 is connected to a male electrical connector 42. A male electrical connector 42 of another stepping stone 10 is to be electrically connected with the female electrical connector 40 of the stepping stone shown within FIG. 1. In this manner, similar stepping stones 10 are connected together forming a series of such stones. It is understood that in a normal installation the base comprising the side wall 12 and the bottom 14 is to be embedded within a supportive surface such as a dirt path within a landscaped terrain. Also, the wires 34, as well as the connectors 40 and 42, are designed to be embedded within the supportive surface. To aid in assuring that the stepping stone 10 will remain in place when embedded within the supportive surface, the bottom surface 14 has a plurality of outwardly extending protrusions 44 which are to embed within the supportive surface which generally will be soil.

Fixedly mounted to the interior wall of the bottom surface 14 and located within internal compartment 16 is a ring-shaped support 46. This ring-shaped support 46 is to be constructed of a transparent material with generally a plastic being preferred. Also, it is to be understood that the base, comprising side wall 12 and bottom 14, will be constructed of a plastic with generally a translucent type of plastic being preferable. Also, it is desired that the plastic is capable of being colored. The desirable form of such plastic would be an acrylic, a high impact styrene, a polycarbonate, polypropylene acrylic-butadiene, and polyvinylchloride. The material of construction of the stepping stone 10 is so that the stepping stone can be of the highest strength, the lowest weight, is resistant to solvents and acids as well as ultraviolet light, has a high impact resistance, is resistant to heat and cold and changes in temperature, substantially unaffected by moisture, easily moldable, low in cost, capable of being colored into a wide variety of different types of colors, and capable of evenly diffusing light. The ring-shaped support 46 is shown to be annular. However, it is considered to be within the scope of this invention that the ring-shaped support 46 could be another shape such as a hexagonal configuration for example. Also, the support 46 need not be enclosed. The ring-shaped support 46 has an upper free edge 48.

The upper free edge of the side wall 12 is formed into an annular flange 50. The outer exterior wall surface of this annular flange 50 includes a groove 52. Mounted within the groove 52 is an O-ring seal 54. The exterior surface of the seal 54 is to abut against depending flange 56 of a lid 57. The flange 56 is also annular and is adapted to closely conform against the flange 50 compressing slightly the seal 54. Extending from the depending flange 56 are a plurality of spaced apart tabs 58. Associated with each tab 58 is a hole 60. Each tab 58 is to matingly fit into a recess 62 formed within side wall 12. It is to be noted that the thickness of flanges 50 and 56 is substantially equal to the thickness of the side wall 12. It is to be understood that there will be a plurality, such as three or four in number, of the tabs 58 and thereby there will be formed three or four of the recesses 62 formed within the side wall 12. The tabs 58 are to be evenly spaced apart.

Formed within the flange 50 and centrally disposed relative to each recess 62 is a hole 64. A threaded fastener 66 is to connect with holes 60 and 64 thereby tightly securing in place the lid 57 onto the side wall 12. The function of the seal 54 is to prevent entry of moisture within the internal compartment 16. Also, the function of the grommets 36 and 38 is also to prevent moisture within internal compartment 16.

In referring to FIG. 2 of the drawing, it can be seen that the lid 57 is slightly domed. When in its domed configuration, there is a slight space, approximately twenty-five thousandths of an inch, between the inner surface of the lid 57 and the upper free edge 48 of the ring-shaped support 46. This slight gap permits light from the light bulb 20 to be freely transmitted across the entire inner surface of the lid 57. As a result, when the stepping stone 10 is in its normal at rest position, the lid 57 is substantially evenly illuminated by the light bulb 20 producing an even glowing appearance across its entire surface.

Upon the lid 57 incurring a pressing force depicted by arrow 68, the lid 57 will lose it domed configuration by being depressed under the weight represented by arrow 68. The pressure on the lid 57 will result in the lid 57 coming into physical contact with the free edge 48. At this time, further depressing of the lid 57 will be substantially prevented with the result that the lid 57 will be adequately supported so as to not break. It is to be noted that during the time that the pressure is being applied to the lid 57, there will be observable a shadow through the lid 57 created by the ring-shaped support 46. However, once the pressure 68 is released, the shadow is eliminated. Elimination of the shadow is desirable from an appearance point of view. It is for this reason that there is a gap between the lid 57 and the ring-shaped support 46 when the stepping stone 10 is in its at rest position. Therefore, no shadow is observable most of the time and is actually only observable when the stepping stone 10 is stepped upon and during this time the creation of a shadow is essentially of no consequence.

The stepping stone 10 of this invention is designed to be a fully functional stepping stone even though light in weight as opposed to a purely cosmetic piece. The stepping stone 10 is designed to support four hundred pounds of weight. By the inclusion of the transparent ring-shaped support 46, the stepping stone 10 is capable of supporting this amount of weight. Another advantage to having the lid 57 be domed is so that water, such as generated by sprinklers and rain, will run off the lid 57 and not be caused to accumulate thereon. In order to diminish the possibility of a human being slipping when stepping on the lid 57, the upper surface of the lid 57 will normally be textured in some manner as including a mass of small serrations or to be impregnated with abrasive materials such as particles of sand. In any event, the upper or outer surface of the lid 57 does include a non-slip material.

The actual weight of the stepping stone 10 will be approximately four pounds. This amount of weight not only can be handled by a child, but also can be easily handled by women and elderly individuals. Most prior art stepping stones are of a weight substantially in excess of the four pound weight of the stepping stone 10 of the present invention.

What is claimed is:

1. An illuminated stepping stone comprising:

a base having a side wall enclosing an internal chamber, said base having a top and a bottom, said bottom adapted to be embedded within a supportive surface, said top constructed of a translucent material;

a light source mounted within said internal chamber; and support means mounted on said base, said support means located within said internal chamber, said support means being spaced from said side wall, said support means assuming a spaced relationship from said top when said stepping stone in its normal at rest position, said support means physically contacting said top once said top encounters a pressing force of sufficient magnitude.

2. The illuminated stepping stone as defined in claim 1 wherein:

said translucent material comprising a plastic.

3. The illuminated stepping stone as defined in claim 2 wherein:

said support means being ring-shaped, said support means being fixed to said base.

4. The illuminated stepping stone as defined in claim 3 wherein:

said support means having an upper free edge, said upper free edge being spaced approximately twenty-five thousandths of an inch from said top when said stepping stone is in its said normal at rest position.

5. The illuminated stepping stone as defined in claim 4 wherein:

said top being in the form of a removable lid.

6. The illuminated stepping stone as defined in claim 5 wherein:

a seal being included between said lid and said base, said seal functioning to prevent entry of moisture from the ambient into said internal chamber.

7. The illuminated stepping stone as defined in claim 6 wherein:

said top being textured so as to provide an exterior non-slip surface.

8. The illuminated stepping stone as defined in claim 7 wherein:

said support means being transparent.

9. The illuminated stepping stone as defined in claim 8 wherein:

said lid being constructed to assume a domed configuration.

10. An illuminated stepping stone comprising:

a base having a side wall enclosing an internal chamber, said base having a top and a bottom, said bottom adapted to be embedded within a supportive surface, said top constructed of a translucent material;

a light source mounted within said internal chamber;

support means mounted on said base, said support means located within said internal chamber, said support means being spaced from said side wall, said support means to physically contact said top to prevent excessive deflection of said top which could result in fracture of said top; and said support means being ring-shaped, said support means being fixed to said base, said support means being concentric with said side wall, said support means enclosing said light source.

11. The illuminated stepping stone as defined in claim 10 wherein:

said top being in the form of a removable lid.

12. The illuminated stepping stone as defined in claim 11 wherein:

a seal being included between said lid and said base, said seal functioning to prevent entry of moisture from the ambient into said internal chamber.

13. The illuminated stepping stone as defined in claim 10 wherein:

said support means being transparent.

14. An illuminated stepping stone comprising:

a base having a side wall enclosing an internal chamber, said base having a top and a bottom, said bottom adapted to be embedded within a supportive surface, said top constructed of a translucent material;

a light source mounted within said internal chamber;

support means mounted on said base, said support means located within said internal chamber, said support means being spaced from said side wall, said support means to physically contact said top to prevent excessive deflection of said top which could result in fracture of said top;

said lid being constructed to assume a domed configuration; and said support means having an upper free edge, said upper free edge being spaced approximately twenty-five thousandths of an inch from said top when said stepping stone is in its said normal at rest position.

15. An illuminated stepping stone comprising:

a base having a side wall enclosing an internal chamber, said base having a top and a bottom, said bottom adapted to be embedded within a supportive surface, said top constructed of a translucent material;

a light source mounted within said internal chamber;

support means mounted on said base, said support means located within said internal chamber, said support means being spaced from said side wall, said support means to physically contact said top to prevent excessive deflection of said top which could result in fracture of said top; and said support means having an upper free edge, said upper free edge being spaced approximately twenty-five thousandths of an inch from said top when said stepping stone is in its said normal at rest position.

* * * * *